US006627032B1

(12) United States Patent
Chester et al.

(10) Patent No.: US 6,627,032 B1
(45) Date of Patent: Sep. 30, 2003

(54) METHOD OF MAKING A HIGH STRENGTH AND SINGLE USE BED AND GURNEY COVERING

(75) Inventors: Kenneth Chester, Randolph, NJ (US); Wilton F. Dees, Weston, CT (US); Joseph P. McGuire, Wilton, CT (US); Robert P. Reichman, Randolph, NJ (US)

(73) Assignee: Fiber-Tec, Inc., Morris Plains, NJ (US)

( * ) Notice: Subject to any disclaimer, the term of this patent is extended or adjusted under 35 U.S.C. 154(b) by 0 days.

(21) Appl. No.: 09/291,281

(22) Filed: Apr. 14, 1999

Related U.S. Application Data

(60) Provisional application No. 60/107,715, filed on Nov. 9, 1998.

(51) Int. Cl.[7] ..... B32B 31/00

(52) U.S. Cl. ..... 156/256; 156/160; 156/229; 156/269; 156/299; 5/487; 5/497; 5/499; 28/103; 19/161.1

(58) Field of Search ..... 5/487, 49.7, 499; 19/161.1; 28/103; 156/160, 229, 256, 270, 299, 269, 93

(56) References Cited

U.S. PATENT DOCUMENTS

| | | | | | |
|---|---|---|---|---|---|
| 3,485,706 | A | | 12/1969 | Evans | 428/134 |
| 3,493,462 | A | | 2/1970 | Bunting, Jr. et al. | 442/405 |
| 3,508,308 | A | | 4/1970 | Bunting, Jr. et al. | 28/104 |
| 3,620,903 | A | | 11/1971 | Bunting, Jr. et al. | 442/415 |
| 3,629,047 | A | * | 12/1971 | Davison | 428/110 |
| 3,654,059 | A | | 4/1972 | Zisblatt | 428/415 |
| 3,765,040 | A | | 10/1973 | Holstein | 5/487 |
| 3,859,678 | A | | 1/1975 | Davis | 5/487 |
| 3,985,130 | A | | 10/1976 | Wideman | 128/846 |
| 4,226,231 | A | | 10/1980 | Andersen | 128/870 |
| 4,648,186 | A | * | 3/1987 | Dolman et al. | 34/9 |
| 4,702,957 | A | | 10/1987 | Mudge | 442/327 |
| 4,744,118 | A | | 5/1988 | Lunt | 5/487 |
| 4,774,118 | A | | 9/1988 | Davis et al. | 428/71 |
| 5,009,747 | A | * | 4/1991 | Viazmensky et al. | 162/115 |
| 5,026,587 | A | * | 6/1991 | Austin et al. | 428/91 |
| 5,068,936 | A | | 12/1991 | Blitzer | 5/487 |
| 5,268,222 | A | | 12/1993 | Honeycutt | 442/270 |
| 5,500,281 | A | | 3/1996 | Srinivasan et al. | 428/131 |
| 5,508,102 | A | | 4/1996 | Georger et al. | 442/400 |
| 5,652,041 | A | | 7/1997 | Buerger et al. | 428/198 |

* cited by examiner

*Primary Examiner*—Linda Gray
(74) *Attorney, Agent, or Firm*—E. Morris

(57) ABSTRACT

Specific nonwoven fabrics having a good hand, high strength both wet and dry, and very high absorbency are useful for disposable health care and commercial bedding material. These fabrics are composed of randomly entangled natural and synthetic fibers interconnected so that the individual fibers are held in place to form a coherent, stable, strong fabric having a high absorption capacity. The fabrics are cut and converted to the desired dimensions. Bottom coverings can include elastic strips that can be fastened for a close fit to beds, cribs, gurneys and the like, regardless of shape.

17 Claims, No Drawings

METHOD OF MAKING A HIGH STRENGTH AND SINGLE USE BED AND GURNEY COVERING

This application claims priority from Provisional application Serial No. 60/107,715 filed Nov. 9, 1998.

This invention relates to low cost, single use, strong and absorbent coverings for health care and commercial bedding.

BACKGROUND OF THE INVENTION

Conventional fabrics for use as bedding in the home and in the health care and commercial fields are generally made of natural fibers, such as cotton or linen, or mixtures thereof with polymeric materials such as polyester, rayon or nylon. These fabrics are comparatively expensive, but in the home they can be laundered for years, reducing the overall cost of the bedding. In the health care and commercial fields however, where numerous individuals use the same conventional linen, intensive laundering protocols are required to remove bodily fluids such as blood, urine and the like, that can cause disease and infections. Thus strong cleaning compounds, such as chlorinated bleach and strong detergents, as well as high temperatures, are required to effectively remove these bodily fluids from the bedding and break down or inactivate the infectious bodies. In turn these harsh laundering protocols begin to deteriorate conventional bedding fabrics, shortening their lifetime to only about 15–17 washing cycles, thus increasing their overall cost. Additionally, the laundering process itself is becoming more expensive. In a health care or commercial facility, the bedding first must be stripped, collected and handled multiple times each day, further adding to the cost of providing bedding for beds, gurneys, cribs, MRI platforms and the like.

Further, health care and commercial providers must maintain a large inventory of sheets, pillow covers, gurney coverings and the like to ensure an adequate supply to meet daily and emergency requirements.

The costs of purchasing and maintaining an adequate supply of clean bedding and coverings has continued to rise. This is due not only to purchase expenses, but also because of the disappearance of a considerable quantity of bedding. For example, patient transport emergency vehicles must also maintain a supply of bedding on hand; when such vehicles are diverted to other health care facilities, such bedding is not returned to its original source. Theft on the part of health care and emergency care providers is not unknown either. Since conventional hospital linens are about the same size as those used in the home, they are equally useful there. Such losses can amount to several millions of dollars per year for a large hospital or commercial establishment.

Thus a search for lower cost alternatives to conventional bedding has been sought. In particular, materials or fabrics that are inexpensive enough to be disposed of after each use, eliminating the need for laundering and handling, would be advantageous.

In order to be cost competitive however, these materials must be inexpensive, but they must also be strong, i.e., they must be able to lift and transfer a patient, wet or dry, from one support surface to another, and they must have an absorbency equal to, and preferably better than, conventional bedding. In addition, the fabric must have a good hand and a texture that is comfortable next to the skin; it must be easy to use, that is, be able to readily cover a surface platform such as a bed or gurney, and it must be readily removable from such surface platform as well.

Disposable materials that have been used to date are made of organic materials, such as organo metallic chelates admixed with floc, or polymeric plastics such as polyethylene or polyester. However, such materials, whether they are extruded or "spun", tend to stick to the skin, causing discomfort. Further, they have very limited or no absorbency; thus once wetted, the individual must lie on a wet surface until the bedding is changed. Further, currently available disposable bedding tends to stretch under load, unlike conventional bedding. Present day standards for health care bedding require that they be able to lift a 300 pound weight without tearing, so as to be able to transfer a patient from one surface to another, as from a bed to a gurney, without dropping the patient, whether the bedding is wet or dry.

To date, no alternative fabrics have been found that meet all of the present day requirements for disposable bedding for the health care field, or that have potential for commercial fields.

SUMMARY OF THE INVENTION

We have found particular non-woven, strong, lightweight, highly absorbent disposable fabrics that have excellent properties for health care and commercial bed, crib and gurney coverings. This non-woven fabric is comprised of non-woven, randomly entangled natural and synthetic fibers interconnected so that individual fibers are held in place to form a coherent, stable, strong fabric which resembles conventional spun or woven fabrics, particularly in terms of hand. These non-woven fabrics have an unexpectedly high absorbency.

DETAILED DESCRIPTION OF THE INVENTION

As used herein, the health care field applies to hospital care, acute care, nursing homes, infant care, as well as humanitarian aid and the like. Commercial fields include hotels, motels, hostels, nautical applications, sleeping bag liners and the like. Other like applications will present themselves to one skilled in the art, and are meant to be included herein.

Fabrics useful in the present invention are described in several patents owned by duPont de Nemours and Company and sold under their trademark "SONTARA"®. These include U.S. Pat. No. 3,485,706 to Evans, U.S. Pat. No. 3,493,462 to Bunting Jr. et al, U.S. Pat. No. 3,508,308 to Bunting Jr. et al and U.S. Pat. No. 3,620,903 to, Bunting, Jr. et al, all of which are incorporated by reference herein. Other manufacturers have similar products on the market and can be substituted for the above-described fabrics. These fabrics have a smooth feel; they are slightly stretchable in one direction; they need only be cut to the desired size and shape of the platform to be covered and finished, or "converted". The fabric useful herein is principally composed of natural fibers combined with synthetic fibers. These hydroentangled webs display a textile-like hand, they are light in weight, weighing generally between 0.5 to 10 oz per square yard. They are at least as absorbent as, and generally more absorbent, than conventional fabrics made of natural or natural and synthetic blend materials. The addition of cellulosic compositions to the fabrics useful herein increases their absorbency by up to two to three times. They absorb fluids rapidly, and they are strong, whether wet or dry.

These fabrics have been tested and compared both to bed coverings that include natural fibers, such as cotton, and to other bed coverings made of synthetic fibers made in accordance with various well known processes. The synthetic fibers used can be conventional materials such as rayon, nylon, polyester, polypropylene, mixtures thereof or mixtures with other staple fibers. The natural fibers useful herein include wood pulp, paper and the like. The fabrics are made by carding the synthetic fibers to remove clumps, forming fiber strands. These strands are then passed to collectors where they are formed as a single layer or web. Natural materials such as paper or a layer of wood pulp, can be added to the fiber layer. Water jet streams are then used to tangle the fibers so they become interconnected and strong, as explained in U.S. Pat. No. 3,485,706 to Evans, disclosed hereinabove.

The above fabrics thus are light in weight, they are very strong, and, very importantly, we have found they are highly absorbent. In all cases, the above-described non-woven fabric useful in this invention is superior to other non-wovens tested for the present purposes. The non-woven fabrics useful in the invention can be cut into covering sheets and to fitted bottom sheets, for any size bedding platform, particularly including transport and treatment gurneys.

Bottom sheets are fitted by attaching a strip of elastic along at least a portion of the edges of the covering, such as by sewing or gluing the elastic to the fabric.

Treatment gurney mattresses are generally shaped in a six-sided configuration so that the head width is smaller than that of the shoulder or the foot. They have a larger and deeper mattress than transport gurneys. The present materials are particularly cost effective for such platforms. Fitted bottom sheets for these treatment gurneys are made using extra wide fabric, and elastic is used about the majority or all along the outer edge. Nevertheless, because these fitted sheets are of a non-standard size, and are generally narrower than conventional bed bottom sheets, they are not interchangeable. This size difference discourages pilfering. The additional fabric and additional elastic differentiates sheets used on rectangular platforms and those for treatment gurneys; they ensure that the sheet stays affixed to the mattress, particularly when the head or foot thereof is raised or lowered.

Bottom sheets are preferably cut on the bias for added strength. Covering sheets can be cut either on the straight or on the bias. The coverings can be rapidly replaced on the bed, gurney or other platform surface, as required.

The invention will be further described in the following examples, but the invention is not meant to be limited to the details described therein.

EXAMPLE 1

Five fabrics were tested for absorption capacity and speed of absorbency.

Control 1 is a 120 count woven muslim fabric comprising 50% by weight of cotton and 50% by weight of polyester.

Control 2 is a 180 count percale fabric made of 50% cotton and 50% polyester.

Control 3 is a waffle weave polyproylene having a pleasant feel sold as "Protect A Med® by the Protect-A-Med Corporation of Fort Lauderdale, Fla. This product is in commercial use as a disposable covering.

Control 4 is a fabric made from organo metallic chelates and floc sold by Hospital Disposable Linens, Inc of Fort Myers, Fla.: as "Flock-a-lite". This fabric has a very smooth "plastic film" feel, is not breathable, has no nap and is very elastic. This product is also commercially available as a disposable bed covering.

Control 3 is a waffle weave polypropylene having a pleasant feel sold as "PROTECT A MED®", a trademarked product of the Protect-A-Med Corporation of Fort Lauderdale, Fla. This product is in commercial use as a disposable covering.

Control 4 is a fabric made from organo metallic chelates and floc sold by Hospital Disposable Linens, Inc. of Fort Myers, Fla. as "FLOCK-A-LITE" fabric. This fabric has a very smooth "plastic film" feel, is not breathable, has no nap and is very elastic. This product is also commercially available as a disposable bed covering.

Example 1 is a sample of the present invention made of a mixture of 45% by weight of polyester and 55% by weight of wood pulp, sold by duPont de Nemours and Company under their trademark SONTARA® for non-woven fabrics.

TABLE I

| Sample | Weight, oz/yd$^2$ | Absorptive capacity, gm | Absorbency Time, sec. |
|---|---|---|---|
| Control 1 | 3.24 | 13.5 | 1.6 |
| Control 2 | 3.40 | 9.9 | 1.2 |
| Control 3 | 1.36 | Did not wet after 60 minutes | |
| Control 4 | 1.40 | 8.3 | 18.0 |
| Example 1 | 2.08 | 26.1 | 2.0 |

Controls 3 and 4 were unsatisfactory because of their long absorbency times or complete lack of absorption. The present fabric has a higher absorptive capacity, almost double, that of the conventional natural fiber-containing mixtures of Controls 1 and 2. The absorption time is substantially the same, particularly as compared to other synthetic fabrics tested.

The Controls and Example were also tested for tear strength, both breaking strength and tear strength. Breaking strength was tested according to ASTM text D5034-95 and tear strength was tested according to ASTM test D2261-96. The results are summarized below in Table II.

TABLE II

| | Breaking strength | | Tearing Strength, lbs | |
|---|---|---|---|---|
| Fabric | Warp (MD) | Fill (CD) | Warp (MD) | Fill (CD) |
| Control 1 | 52 | 39 | 3.6 | 3.7 |
| Control 2 | 68 | 46 | 2.5 | 2.9 |
| Control 3 | 27 | 16 | 6.1 | 4.3 |
| Control 4 | 8 | 7 | 1.6 | 1.1 |
| Example 1 | 30 | 23 | 3.1 | 1.8 |

Thus the highest strength fabrics included natural fibers, but the fabric of the present invention was better in break strength than the other synthetic fibers tested that are presently in use as disposable bedding.

EXAMPLE 2

This example simulates the ability of sheets made of the fabric as described above as useful herein to transfer a patient from one surface to another. The tests were done both dry and wet according to tear strength ASTM test D2261-96.

A sheet of the fabric of the invention 39"×85" in size was conditioned for 48 hours at 70° F. and 50% RH and spread out on a platform. A non-resilient liner was placed on the sheet, and steel weights having a total weight of 300 lbs were uniformly distributed about the center of the fabric. A total of six persons, one positioned at each of the four corners and one each in the middle of the long edges lifted the sheet three feet above the floor and held it there for 30 seconds. Although the sheet cut along the straight of the fabric failed at one of the lift locations at a long edge, the sheet cut along the bias sustained the 300 pound weight without any damage. Thus the present fabric is stronger when cut on the bias.

The above test was repeated except that a quart of water was poured onto the fabric after the conditioning step. No failure of the wet sheet was noted at all.

Although the invention has been described in terms of particular embodiments, one skilled in the art will recognize that various changes can be made by substituting like synthetic fabrics. The invention is only meant to be limited by the scope of the appended claims.

We claim:

1. A method of providing disposable, strong, absorbent health care and commercial bedding which comprises providing a non-woven fabric comprised of randomly entangled mixtures of natural and synthetic fibers interconnected so that the individual fibers are held in place to form a coherent, stable, strong fabric having a high absorbency capacity;

cutting the fabric to the desired length in the cross direction; and converting said fabric to a desired size and shape.

2. A method according to claim 1 wherein said natural fiber is cellulosic wood pulp.

3. A method according to claim 1 wherein said synthetic fiber is selected from the group consisting of a polyester, a nylon, a rayon, a polypropylene and mixtures thereof.

4. A method according to claim 1 wherein said synthetic fiber is polyester.

5. A method of providing disposable strong, absorbent health care and commercial bedding which comprises employing as the bedding material a fabric principally composed of polyester fibers combined with cellulosic wood pulp fibers, said fibers locked into place by a three-dimensional fiber entanglement wherein the individual fibers are intertwined, tangled and interconnected to each other so as to be virtually inseparable, said fabric having an absorptive capacity of at least that of woven fabric made of natural fibers, cutting the fabric to a desired length in the cross direction, and converting said cut fabric to a desired size and shape.

6. A method according to claim 5 wherein the fabric has a weight 0.5 to 10 ounces per square yard.

7. A method according to claim 5 wherein, after cutting said bedding material in the cross (CD) direction, a strip of elastic is attached along the edges to provide a close fit to a platform it is to cover.

8. A method according to claim 7 wherein the platform is a six-sided gurney.

9. A method of providing disposable, strong, moisture absorbent health care and commercial bed and gurney coverings which comprises employing as the bedding material a fabric principally composed of polyester fibers combined with cellulosic wood pulp fibers, said fibers interlocked by a three-dimensional fiber entanglement wherein the individual fibers are intertwined, tangled and interconnected to each other so as to be virtually inseparable, said fabric having an absorptive capacity higher than that of conventional bedding made from cotton-polyester blends, cutting across the fabric, and converting said bedding material to a desired shape suitable for a gurney covering, so that its strongest direction is along the cut direction of the covering.

10. A method according to claim 9 wherein the fabric is sized and shaped to fit a six-sided gurney.

11. A method according to claim 9 wherein the fabric is sized and shaped to fit a rectangular platform.

12. A method according to claim 9 wherein said bedding material is converted to withstand lifting up to 300 pounds without breaking or tearing.

13. A method according to claim 12 wherein said bedding material is wet.

14. A method of transferring a patient weighing up too about 300 pounds from a first platform surface to a second platform surface which comprises providing a platform covering comprising a fabric principally composed of polyester fibers combined with cellulosic wood pulp fibers, said fibers interlocked by a three-dimensional fiber entanglement wherein the individual fibers are intertwined, tangled and interconnected to each other so as to be virtually inseparable, said fabric having an absorptive capacity higher than that of conventional bedding made from cotton-polyester blends, cutting said fabric across the length to a desired size, turning said fabric ninety degrees, placing a patient upon said covering such that the patient is supported by the strongest direction of said fabric, lifting the covering and the patient above the surface of said first platform, and transferring the covering and the patient onto a second platform.

15. A method according to claim 14 wherein said covering is wet.

16. A method according to claim 1 wherein the bedding is manufactured so that the machine direction (MD) of the fabric runs in the cross direction (CD) of the product.

17. A method according to claim 5 wherein, after manufacturing said bedding material in the cross direction (CD), a strip of elastic is attached along the edges to provide a close fit to a platform it is to cover.

* * * * *